US009074447B1

(12) United States Patent
Cox

(10) Patent No.: US 9,074,447 B1
(45) Date of Patent: Jul. 7, 2015

(54) METHOD AND SYSTEM FOR PROTECTING WELLHEAD INTEGRITY

(71) Applicant: Brent Cox, Houston, TX (US)

(72) Inventor: Brent Cox, Houston, TX (US)

(73) Assignee: TRENDSETTER ENGINEERING, INC., Houston, TX (US)

( * ) Notice: Subject to any disclaimer, the term of this patent is extended or adjusted under 35 U.S.C. 154(b) by 0 days.

(21) Appl. No.: 14/156,015

(22) Filed: Jan. 15, 2014

(51) Int. Cl.

| | |
|---|---|
| ***E21B 33/038*** | (2006.01) |
| ***E02D 27/52*** | (2006.01) |
| ***E21B 33/03*** | (2006.01) |
| ***E21B 33/064*** | (2006.01) |
| ***E21B 41/04*** | (2006.01) |
| *B63B 21/50* | (2006.01) |

(52) U.S. Cl.
CPC ..... *E21B 33/038* (2013.01); *E02D 27/525* (2013.01); *B63B 21/502* (2013.01); *B63B 21/50* (2013.01); *E21B 33/03* (2013.01); *E21B 33/064* (2013.01); *E21B 41/04* (2013.01)

(58) Field of Classification Search
CPC ..... E21B 33/03; E21B 33/038; E21B 33/064; E21B 41/04; E21B 29/10; E21B 29/12; B63B 21/50; B63B 21/502; F16G 11/12; E02D 27/525
See application file for complete search history.

(56) References Cited

U.S. PATENT DOCUMENTS

| | | | | |
|---|---|---|---|---|
| 4,011,694 | A * | 3/1977 | Langford | 52/1 |
| 4,185,694 | A * | 1/1980 | Horton | 166/350 |
| 4,367,982 | A * | 1/1983 | Hubbard | 405/223.1 |
| 4,448,266 | A * | 5/1984 | Potts | 175/7 |
| 4,471,709 | A * | 9/1984 | Chun | 114/293 |
| 4,597,350 | A * | 7/1986 | Mott | 114/230.13 |
| 4,702,321 | A * | 10/1987 | Horton | 166/350 |
| 4,710,061 | A * | 12/1987 | Blair et al. | 405/195.1 |
| 5,788,417 | A * | 8/1998 | Fontenot et al. | 405/224 |
| 7,389,820 | B2 | 6/2008 | Day | |
| 7,467,913 | B1 * | 12/2008 | Allen et al. | 405/224 |
| 8,261,840 | B2 | 9/2012 | Parlee | |
| 2006/0042800 | A1 * | 3/2006 | Millheim et al. | 166/344 |
| 2012/0201608 | A1 * | 8/2012 | Belinsky et al. | 405/203 |
| 2013/0206419 | A1 | 8/2013 | Hallundbadek et al. | |
| 2014/0352972 | A1 * | 12/2014 | Gutierrez et al. | 166/335 |

FOREIGN PATENT DOCUMENTS

| | | | | |
|---|---|---|---|---|
| WO | WO2005080131 | * | 9/2005 | B60P 7/08 |

OTHER PUBLICATIONS

U.S. Appl. No. 61/838,709, filed Jun. 24, 2013, and entitled "System and Method for Tethering Subsea Blowout Preventers to Enchance Strength and Fatigue Resistance Thereof".

* cited by examiner

*Primary Examiner* — John Kreck
*Assistant Examiner* — Carib Oquendo
(74) *Attorney, Agent, or Firm* — Egbert Law Offices, PLLC

(57) ABSTRACT

A method of protecting an integrity of a wellhead includes the steps of affixing a subsea structure to the wellhead, installing a plurality of piles into the subsea floor adjacent the wellhead, extending lines between the subsea structure and the piles, and tensioning the lines such that each of the lines applies tension to the subsea structure. The plurality of lines are secured to an upper portion of the subsea structure. The tensioning mechanism has a tensioning cylinder having a ratchet rod extending therefrom. The ratchet rod is connected to either the line, the pile or the subsea structure.

3 Claims, 9 Drawing Sheets

METHOD AND SYSTEM FOR PROTECTING WELLHEAD INTEGRITY

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to the protection of a wellhead. More particularly, the present invention relates to the support of subsea structures at the wellhead. More particularly, the present invention relates to techniques for assuring that the subsea structure does not deflect or bend to such an extent as to damage the wellhead.

2. Description of Related Art Including Information Disclosed Under 37 CFR 1.97 and 37 CFR 1.98

In the exploration for hydrocarbons and for the production of hydrocarbons, it is necessary for various subsea structures to be affixed to the wellhead. The subsea structures can include items such as capping stacks, blowout preventers, Christmas trees, and other equipment. The subsea structures are often quite heavy. As such, if the wellhead is canted at a slight angle to horizontal or if the subsea structure is applied to the wellhead at an angle that is offset from vertical, undesirable moments can be applied to the wellhead.

Such subsea structures are becoming increasingly heavy in view of the pressures encountered by the well. Since heavier structures are being applied to the wellhead, there is a possibility for significant moments to be applied to the wellhead. In other circumstances, wellheads are often improperly installed so that they tend to have a top surface that is angularly displaced from being perfectly horizontal. As such, whenever a subsea structure is applied to such an offset wellhead, the subsea structure will be angled slightly to one side or another. Once again, the weight applied by the subsea structure to such an angularly offset wellhead can create undesirable moments to the wellhead.

Under certain circumstances, when extreme forces are applied to the wellhead, the wellhead can be significantly damaged. Procedures are not available for effectively repairing the wellhead after damage as occurred thereto. In other circumstances, when the wellhead is significantly damaged, there is a possibility of a blowout. As such, relief wells would be required, in order to seal the well. Additionally, if a blowout should occur, undesirable release of hydrocarbons into the subsea environment would occur. As such, there is a significant need for protecting the integrity of a wellhead in a subsea location.

In the past, various patents have issued for techniques for protecting the integrity of the wellhead. For example, U.S. Pat. No. 7,389,820, issued on Jun. 24, 2008 M. A. Day, describes a blowout preventer positioning system. This blowout preventer positioning system includes a mast that is functionally connected away from the frame assembly and a carriage functionally connected to the mast. The carriage is adapted to carry and support a blowout preventer in a manner such that the blowout preventer might be moved along an angular path along a plurality of linear paths. The system can include a mechanism for rotating the blowout preventer along a first rotational path. The system further includes a mechanism for rotating the blowout preventer along a second rotational path.

U.S. Pat. No. 8,261,840, issued on Sep. 11, 2012 to J. C. T. Parlee, describes a system for the alignment of a blowout preventer stack so as to facilitate the use of a rotating control mechanism. The alignment system includes at least one alignment device positioned between a pair of flanges. The alignment device has a greater thickness on one side of the alignment device that on an opposite side of the alignment device. The system includes a method of producing a relative angular offset between a first flange and a second flange which can include positioning at least one alignment device between the first and second flanges and then securing the alignment device between the first and second flanges so as to produce an angular offset. The method of aligning an axis of a blowout preventer stack with a rig floor can include positioning at least one alignment device between a first flange and a second flange of the blowout preventer stack, securing the alignment device between the first and second flanges, and securing the alignment device between the first and second flanges to produce an angular offset of the second flange relative to the first flange.

U.S. Patent Publication No. 2010/0240373, published on Sep. 27, 2012 D. Devilleger, discloses a method for the in situ repair of a wellhead base flange. At least one layer of polymerizable composite material is applied to a damaged surface, an elastic seal is placed on the layer of composite material, and a reinforcing collar is pressed against the seal on the surface of the flange covered with the composite material. The arrangement of an in situ repair of a base flange of a wellhead includes at least one layer of the polymerized composite material on a damaged surface, an elastic seal on the composite material, and a reinforcing collar pressing the seal against the damaged surface.

U.S. Patent Publication No. 2013/0206419, published on Aug. 15, 2003 to Hallundbadek et al., discloses a blowout preventer and launcher system for being mounted on a wellhead. The system includes a plurality of valves arranged in fluid communication with each other so as to be connected to form a tubular pipe. The system includes a launcher system, a well intervention module, a well intervention system and a well system.

It is an object of the present invention to provide a system and method for protecting the integrity of a wellhead which serves to avoid undesired moments between the subsea structure and the wellhead.

It is another object of the present invention to provide a system and method for protecting the integrity of a wellhead which serves to avoid damage to the wellhead.

It is another object of the present invention to provide a system and method for protecting the integrity of a wellhead that assures that the structure attached to the wellhead will remain in a stationary position throughout the hydrocarbon exploration and production activities.

It is still further object the present invention to provide a system and method for protecting the integrity of a wellhead which is easy to use, easy to deploy, easily implemented and relatively inexpensive.

These and other objects and advantages of the present invention will become apparent from a reading of the attached specification and appended claims.

BRIEF SUMMARY OF THE INVENTION

The present invention is a method for protecting an integrity of a wellhead which includes the steps of: (1) affixing a subsea structure to the wellhead; (2) installing at least a pair of piles into the subsea floor adjacent the wellhead; (3) extending lines between the subsea structure and the piles; and (4) tensioning the line such that each of the lines applies a tension to the subsea structure. An end of each of the lines is affixed to the subsea structure adjacent an upper portion of the subsea structure.

Each of the piles has a tensioning mechanism at a top thereof. The step of tensioning includes drawing the line by the tensioning mechanism until a desired amount of tension is applied to the subsea structure. In one embodiment of the present invention, the tensioning mechanism has a reel about which the line extends. A portion of the line is extended upwardly from the reel. The line is winched from a location above the reel until the desired amount of tension is achieved. The line is then locked when the desired amount of attention is achieved. In another embodiment of the present invention, the tensioning mechanism includes a reel with a line extending therearound. The reel is rotated until the desired amount of tension is achieved. The reel is then stopped when the desired amount of tension is achieved. In still another embodiment, the line will have a tensioning cylinder connected thereto. The tensioning cylinder has a ratchet rod extending therefrom. The ratchet rod can either be affixed to the line, the subsea structure, or the pile. The ratchet rod is drawn inwardly of the cylinder until a desired amount of tension is achieved in the line. A position of the ratchet rod is then fixed within the cylinder when the desired amount of tension is achieved.

In the method of the present invention, the step of installing at least a pair of piles includes lowering the pile toward the subsea floor such that a lower end of the pile engages with the subsea floor, and hammering the anchor pile into the subsea floor until the lower end of the anchor pile reaches a desired depth in the subsea floor. In another embodiment of the present invention, the pile has a cylindrical structure with an auger rotatably mounted in an interior thereof. The pile is lowered toward the subsea floor such that the lower end of the cylindrical structure penetrates into the subsea floor. The auger is then rotated so as to draw the cylindrical structure to a desired depth in the subsea floor.

At least four piles are installed in the subsea floor in spaced locations around the wellhead. The lines are respectively fixed to different locations on the subsea structure. The lines are also respectively affixed to the piles in a slack state.

In the present invention, the subsea structure can be a blowout preventer, a Christmas tree a capping stack, a flow diverter, and similar structures. Approximately equal tensions are applied to each of the lines on opposite sides or opposite corners of the subsea structure.

The present invention is also a system for protecting for protecting and integrity of a wellhead. The system includes a subsea structure suitable for attachment to the wellhead, a plurality of lines affixed to the subsea structure and extending outwardly therefrom, a plurality of piles arranged at a distance from the subsea structure, and a tensioning mechanism cooperative with each of the plurality of lines so as to apply tension thereto.

The plurality of lines are affixed adjacent to an upper portion of the subsea structure. The tensioning mechanism is positioned atop each of the plurality of piles. The tensioning mechanism is suitable for applying a desired amount of tension to the line.

In one embodiment, the tensioning mechanism can include a reel that is rotatably mounted to a top of the pile and having the line extending around the reel such that the line extends upwardly from the reel and extends outwardly toward the subsea structure. A winch is positioned above the pile and is engaged with the lines was to pull the line so as to apply tension to the line. In another embodiment, the tensioning mechanism can include a reel having the line extending therearound in which a portion of the line extends outwardly of the reel. A motor is connected to the reel so as to rotate the reel until the desired amount of tension is applied to the line. In another embodiment, the tensioning mechanism can include a tensioning cylinder having a ratchet rod extending therefrom. The ratchet rod is connected to either the line, the pile or the subsea structure. The tensioning cylinder is suitable for drawing the ratchet rod inwardly so as to apply the desired amount of tension to the line.

Each of the plurality of piles can include a cylindrical structure having an open end. An auger extends within an interior of the subsea structure. The auger is rotatable so as to draw the cylindrical structure into the subsea floor.

The plurality of lines include four lines extending radially outwardly of the subsea structure in generally evenly angularly spaced relationship to each other. The plurality of piles can include four piles that are respectively connected to the four lines. Each of the plurality of lines on opposite sides or opposite corners of the subsea structure are equally tensioned. Each of the plurality of lines is attached to an upper portion of the subsea structure.

This foregoing Section is intended to describe, with particularity, the preferred embodiments of the present invention. It is understood that modifications to these preferred embodiments can be made within the present invention. As such, this Section should not be construed as limiting the broad scope of the present invention. The present invention should only be limited by the following claims and their legal equivalents.

DETAILED DESCRIPTION OF THE INVENTION

Figure 1:
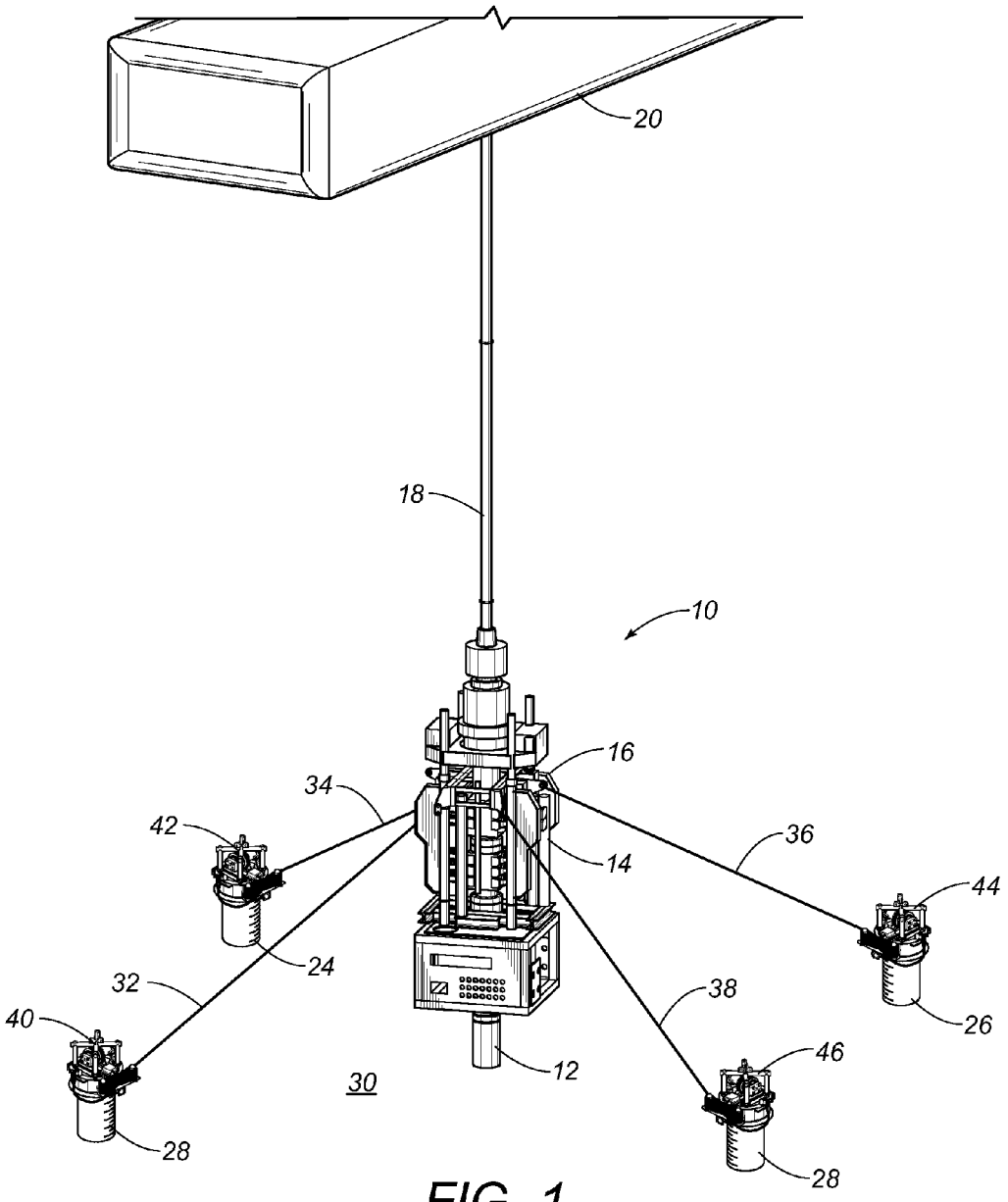
FIG. 1 is a perspective view showing the completed installation of the wellhead integrity system of the present invention.

Referring to FIG. 1, there is shown the completed wellhead integrity system in accordance with the teachings of the present invention. The wellhead integrity system 10 includes a wellhead 12 having a subsea structure 14 affixed to the wellhead 12. Subsea structure 14, as illustrated, is a blowout preventer. However, within the concept of the present invention, the subsea structure 14 can include a wide variety of other items such as capping stacks, flow diverter, Christmas trees, mudline closure devices and other mechanisms. It can be seen that the subsea structure 14 extends upwardly from the wellhead 12 for a considerable distance. The subsea structure 14 has an upper portion 16 to which a riser 18 is attached. The riser 18 extends to a surface location 20 located above the body water.

Within the system 10 of the present invention, the can be seen that there are four piles 22, 24, 26 and 28 that are embedded in the subsea floor 30. Conventionally, the piles 22, 24, 26 and 28 can be embedded in the subsea floor 30 by hammering. As such, they will be embedded in the subsea floor a sufficient distance such that the friction between the piles and the earth at the subsea floor 30 will rigidly affix each of the piles in their desired positions. In particular, it can be seen that the anchor piles 22, 24, 26 and 28 are positioned in spaced relation to the wellhead 12 and the subsea structure 14. These piles 22, 24, 26 and 28 will be generally evenly spaced from each other and from the subsea structure 14.

In FIG. 1, the system 30 includes a first line 32 extending from the pile 22 to an upper portion of the subsea structure 14. The pile 24 has a line 34 extending therefrom to another location on the subsea structure 14. The pile 26 has a line 36 extending therefrom to another location at the upper portion of the subsea structure 14. The pile 28 has a line 38 extending therefrom to another location at the upper portion of the subsea structure 14. Each of the lines 32, 34, 36 and 38 is relatively evenly angularly spaced from each other.

Importantly, each of the piles 22, 24, 26 and 28 has a tensioning mechanism positioned on a top thereof. The pile 22 has tensioning mechanism 40 positioned at a top thereof. The line 32 is cooperative at the tensioning mechanism 40 such that the tensioning mechanism 40 can apply a tension to the line 32. Similarly, another tensioning mechanism 42 is placed atop the pile 24 so as to be cooperative with the line 30. Another tensioning mechanism 44 is placed atop the pile 26 and is cooperative with the line 36 so as to apply a tension thereto. Finally, another tensioning mechanism 46 is placed atop the pile 28 so as to apply a tension to the line 38.

Within the concept of the present invention, so as to protect the integrity of the wellhead 12, generally an equal tension is applied to those lines at opposite sides of the subsea structure 14. As such, the tensions in lines 32 and 36 will be approximately equal. Similarly, the tensions applied the line 34 and 38 will be approximately equal. In FIG. 1, it can be seen that each of the lines 32, 34, 36 and 38 is applied to the sides of the subsea structure 14. Alternatively, these lines 32, 34, 36 and 38 can be applied to the four corners at the upper portion of the subsea structure 14. By applying relatively equal tension to all of the sides of the upper portion of the subsea structure 14, the subsea structure 14 is effectively prevented from deflecting in any way during offshore exploration and production activities. These lines 32, 34, 36 and 38 can serve to compensate for any deflecting forces that could be applied to the subsea structure 14. As such, the subsea structure 14 will be maintained at a proper orientation relative to the wellhead 12. If the wellhead 12 is deflected such that the top surface thereof is offset from horizontal, then the tensioning of the various lines 32, 34, 36 and 38 will compensate for any adverse moments that may be applied to the wellhead by the subsea structure. As such, the tensions in each of the lines 32, 34, 36 and 38 can be adjusted so as to compensate for the forces such that the subsea structure 14 will not exert any moments upon the wellhead 12.

Figure 2:
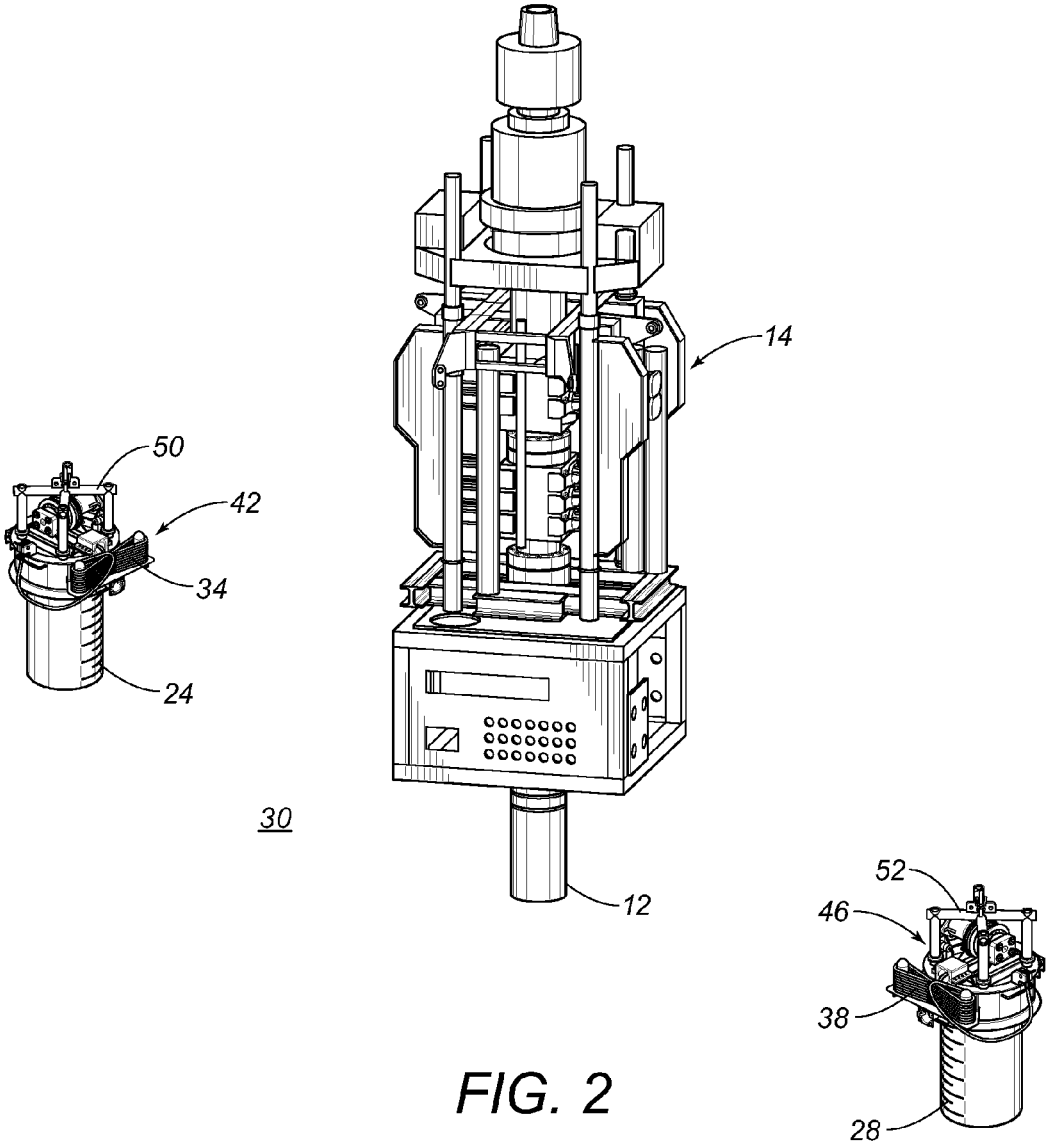
FIG. 2 shows an early step in the method for the installing of the wellhead integrity system.
Figure 5:
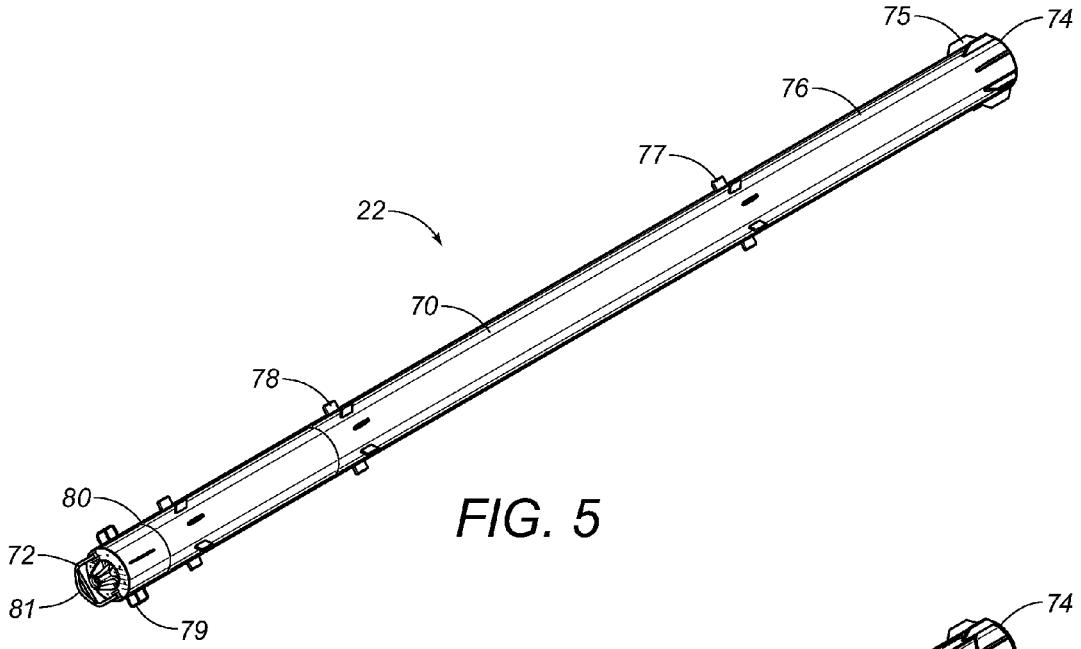
FIG. 5 is a perspective view of a pile as used in the wellhead integrity system of the present invention.
Figure 6:
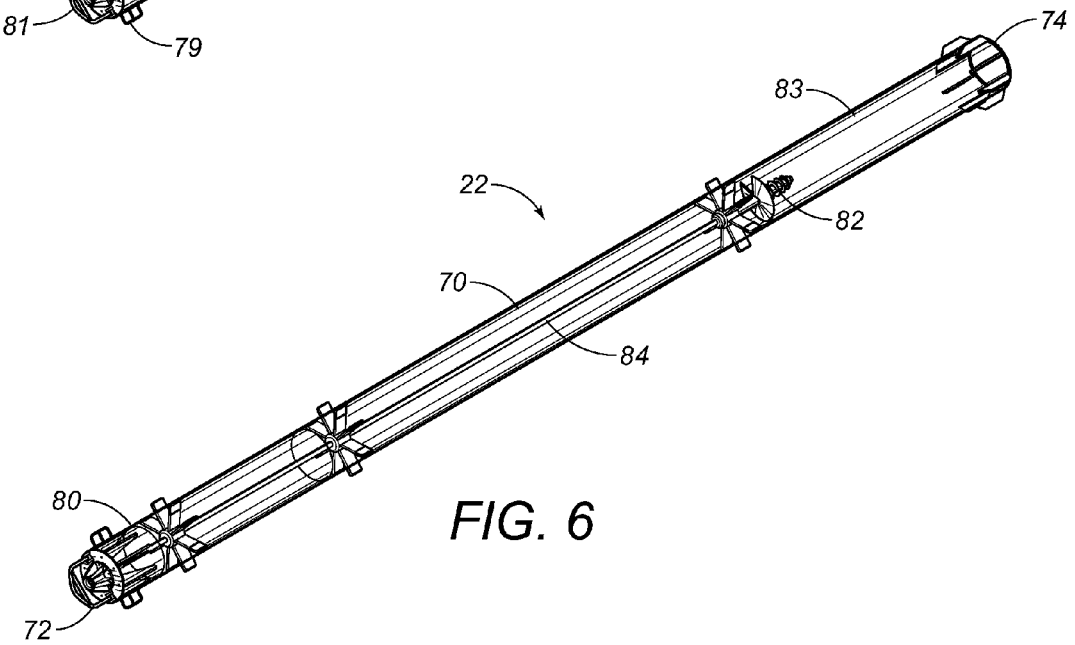
FIG. 6 is a transparent view of a pile as used in the wellhead integrity system of the present invention.
Figure 7:
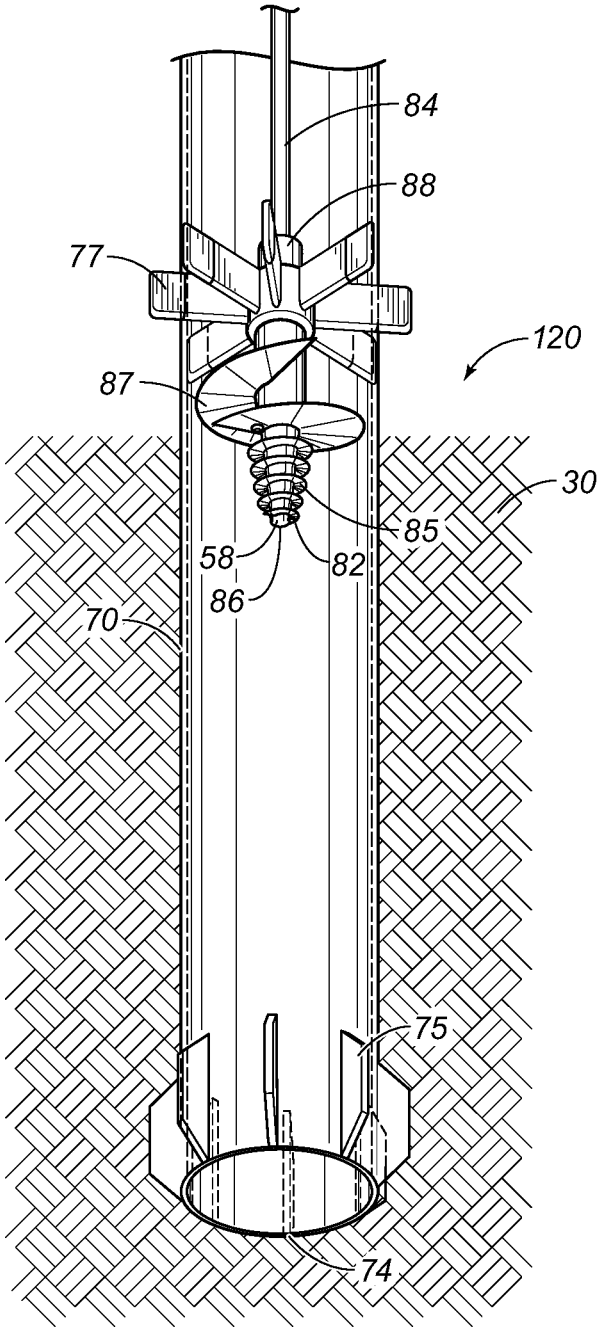
FIG. 7 is a transparent perspective view showing a pile as used in the wellhead integrity system of the present invention.

FIG. 2 shows an early stage in the method of installing the wellhead integrity system of the present invention. In FIG. 2, can be seen that the subsea structure 14 has been installed upon the wellhead 12. Initially, the pile 24 will have the tensioning mechanism 42 affixed thereto. The tensioning mechanism 42 can be affixed to the top of the pile 24 at a surface location prior to lowering the pile 24 toward the subsea floor 30. The pile 24 can be lowered from a surface location downwardly through the body of water until the lower end of the pile 24 encounters or engages the subsea floor 30. Subsequently, a suitable hammering mechanism, as conventionally employed, can be used so as to drive the anchor pile 24 downwardly into the subsea floor. Alternatively, the anchor pile 24 can include the structure is shown in FIGS. 5-7 so as to be effectively positioned in the subsea floor 30. The pile 28 is also installed into the subsea floor in a similar manner. The pile 28 will have tensioning mechanism 46 positioned at a top thereof. The other piles 22 and 24, along with their associated tensioning mechanisms 40 and 44, can be installed in a similar manner. It can be seen that the piles 24 and 26 are generally equally spaced from the wellhead 12 on opposite sides of the subsea structure 14. The line 34 is wrapped around a frame 50 associated with the tensioning mechanism 42. Similarly, the line 38 will be wrapped around the frame 52 of the tensioning mechanism 46.

Figure 3:
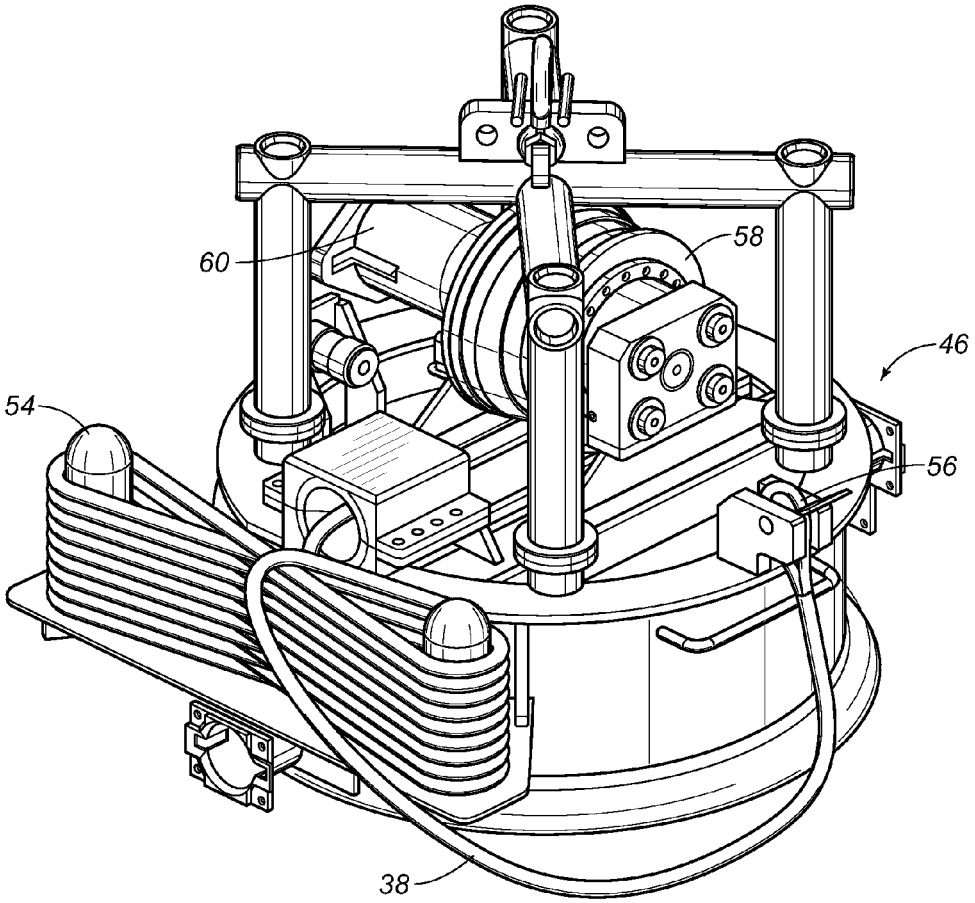
FIG. 3 is a perspective view showing a preferred embodiment of the tensioning mechanism of the wellhead integrity system of the present invention.

FIG. 3 illustrates the tensioning mechanism 46 as shown in the circled area of FIG. 2. It can be seen that the line 38 has been wrapped around vertical supports 54 at one side of the tensioning mechanism 46. An end 56 of the line 38 is positioned within a receptacle. The end 56 will include a suitable hook or loop that can the secured by an ROV. The line 38 is also wrapped around a reel 58. Reel 58 can be driven by motor 60. In normal use, and ROV will grasp the loop 58 at the end of the line 38 so as to transport the line 38 toward the subsea structure 14. The line 38 will unravel off the vertical supports 54.

Figure 4:
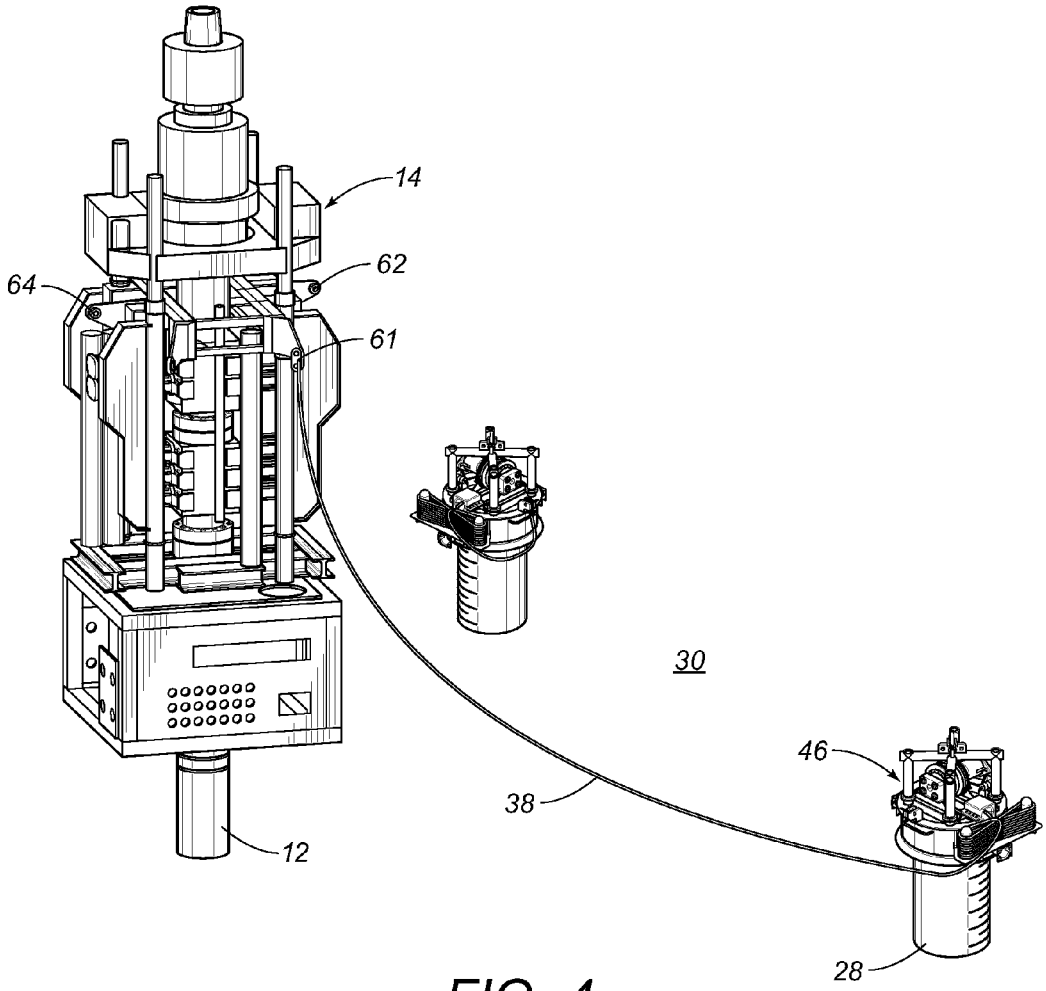
FIG. 4 shows a later stage in the method of installing the wellhead integrity system of the present invention.

FIG. 4 illustrates that the line 38 is extended to a padeye 61 located on the subsea structure 14. In this circumstance, the ROV has moved toward the subsea structure 14 with the line 38 secured thereto. The end of the line 38 is then secured to the padeye 61. The tensioning mechanism 46 will then act on the line 38 by the rotation of the reel 58 as caused by motor 60. When a desired amount of tension has been placed on the line 38, the motors 60 will stop so as to stop the rotation of the reel 58. As such, the line 38 will be properly locked in position with the desired amount of tension. The padeye 61 can include a suitable strain gauge or tension gauge connected thereto so that the operation can be monitored from a surface location. As such, when the desired tension is achieved, the rotation of the motor 60 can be stopped.

It should be noted that the line 38 is installed, at all of its locations, in a slack manner. So as to ensure that equal tensions are applied to the various lines 32, 34, 36 and 38 by the respective tensioning mechanisms 40, 42, 44 and 46, the various motors associated with the tensioning mechanism can be operated in unison so that consistent forces are applied throughout the installation of the line 38. The operation of the motors associated with each of the tensioning mechanisms can be carried out by acoustic signals directed to an actuator associated with such motors. Alternatively, each of the motors can be operated independently, but only operated in a gradual manner until proper even forces are applied to the various lines connected to the subsea structure. The subsea structure 14 will include various other padeyes 62 and 64 so as to allow the attachment of the other lines. Another padeye can be located on opposite side of the subsea structure 14 from the padeye 61. Each of the padeyes will include suitable transducers or strain gauges so that the tensioning can be monitored during installation.

Each of the piles 22, 24, 26 and 28 can have a configuration shown in FIGS. 5-7. This configuration is specifically described in U.S. Pat. No. 8,215,873 and U.S. Pat. Nos. 8,214,873 and 8,371,771, which have issued to the present inventor and are owned by Trendsetter, Inc. For the purposes of description, the pile 22 is illustrated in FIG. 5. Each of the other anchor piles 24, 26 and 28 can have a similar configuration. The pile 22 includes a tubular member 70 with an upper end 72 and the lower end 74. The tubular member 70 has a first set of fins 75 positioned adjacent to the lower and 74 and extending outwardly of an exterior surface 76 of the tubular member 70. A second set of fins 77 extends radially outwardly of the exterior surface 76 of the tubular member 70 in spaced relationship to the first set of fins 75. A third set of fans 78 extends radially outward way in spaced relationship to the second set of fins 77. A fourth set of fins 79 extends radially outwardly at the upper and 72 of the tubular member 70. A support structure 80 is affixed to the upper end 72 of the tubular member 70. The support structure 80 includes a TLP/vessel locking connection 81 at an end thereof. This locking mechanism 81 allows the mechanisms within the interior passageway of the tubular member 70 to be suitably connected to a torquing tool. The torquing tool can be suitably carried, in a conventional manner, by the remotely-operated vehicle (ROV).

FIG. 6 is a transparent view of the pile 22 of the present invention. In FIG. 6, it can be seen that there is an auger 82 positioned within the interior passageway 83 of the tubular member 70. The auger 82 has a spiral-type vane which can be rotated so as to install the pile 22. The auger 82 is located in a position between the lower end 74 and the upper end 72 of the tubular member 70. A shaft 84 extends through the interior passageway 83 of the tubular member 70 and is connected to a torquing tool interface located in the support structure 80. Within the concept of the present invention, the auger 82 can also be located outwardly of the lower and 74 of the tubular member 70. The auger 82 is supported by the shafts 84 and support bearings associated with the shaft 84. These thrust bearings will allow for the rotation of the shaft 84 (along with the auger 82) while preventing axial movement of the auger 82 and the shaft 84 within the interior passageway 83.

When a torque tool is connected to the torque tool interface in the support structure 80, the torque tool can apply a rotational motion to the shaft 84. This will cause a rotation of the auger 82. In normal use, the pile 22 is first transported offshore on a barge. The pile 22 is picked up and over boarded into the water. It is then up ended so that the lower end 74 will face the subsea floor. The pile 22 can be attached to an abandonment and recovery winch so as to be lowered to the targeted location at the subsea floor 30. The pile 22 will self-penetrate into the seabed to a predetermined depth. Prior to reaching the full self-penetrating length, the auger 82 will contact the seabed. The hydraulic torque tool is installed on the torque tool interface of the support structure 80 so as to rotate the auger 82. As the auger 82 cuts through the subsea soil, it will serve to draw the tubular member 70 in a downward direction. The fins 75 at the lower and 74 of the tubular member 70 will prevent rotation and counteract torque rotation of the hydraulic torque tool. The hydraulic torque is transmitted to the auger 82 by way of the shaft 84. The shaft 84 can be in the nature of a drill pipe. The auger 82 can initially contact the subsea soil so as to rotate so as to draw the tubular member 70 downwardly toward the seabed.

FIG. 7 illustrates the operation of the pile 22 in conjunction with the subsea floor 30. It can be seen that the lower end 74 of the tubular member 70 is lowered to a predetermined depth within the subsea floor 30. The tubular member 70 is lowered into the subsea floor 32 for a depth such that the auger 82 will contact the subsea soil below the floor 30. The auger 82 has a generally spiral vane 85 formed with a pointed end 86. Wider vanes 87 extend in a spiral pattern radially outwardly of the auger 82. A suitable lubricating nozzle can be formed on the leading edge of the wider vanes 87 so as to be ejected under pressure in a direction toward the lower end 74 of the tubular member 70. A thrust bearing 88 is illustrated in FIG. 7 is located in a position adjacent to the second set of fins 77. The first set of fins 75 are engaged with the subsea soil below the subsea floor 30 so as to fix a rotational position of the tubular member 70 within the subsea soil and counteract any torque applied to the auger 82. The high-bearing load on the top of the auger 82, as it penetrates into deeper more compact soils, allows the auger 82 to penetrate deeply into the soil. Once the pile 22 is reached a desired depth, the rotation of the auger 82 can cease. Since the soil around the tubular member 70 has consolidated, the majority of the strength of the pile 22 will come from the friction of the soil against the tubular member 70. Additionally, the mud core weight within the interior passageway 83 will provide additional strength, both in tension and compression.

Figure 8:
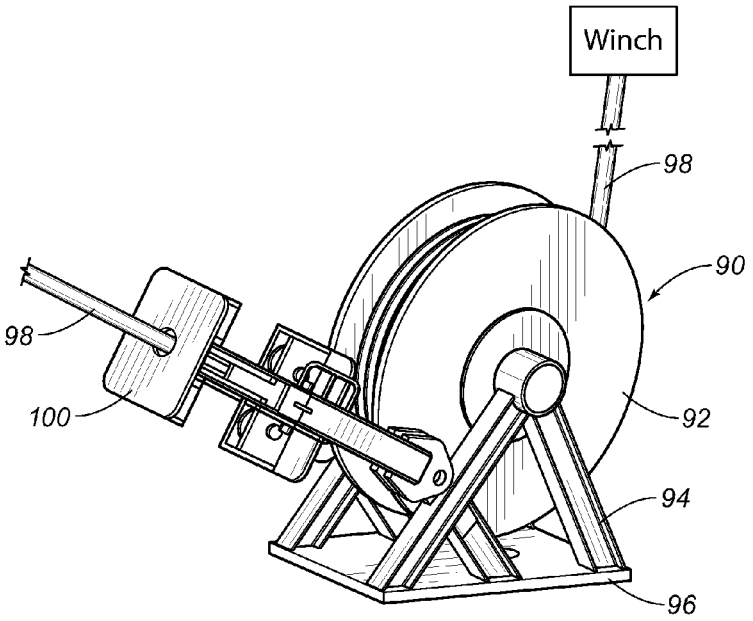
FIG. 8 is a perspective view of an alternative embodiment of the tensioning mechanism of the wellhead integrity system of the present invention showing the tensioning mechanism associated with the line in a slack state.

FIG. 8 shows an alternative embodiment of the tensioning mechanism 90. This tensioning mechanism 90 can be used instead of the previous tensioning mechanisms 40, 42, 44 and 46. The tensioning mechanism 90 is particularly configured whereby a surface location can be utilized so as to provide the necessary tensioning forces. In particular, the tensioning mechanism 90 includes a reel 92 that is rotatably supported by a frame 94. The base 96 of the frame 94 can be affixed to the top of the anchor pile. The line 98 is illustrated as wrapped around the reel 94. An orientation and lock mechanism 100 is pivotally mounted to the frame 94 at one end thereof. The line 98 will extend from the reel 92 and through the orientation and lock mechanism 100. A winch 102 can be positioned at a location above the tensioning mechanism 90. The winch 102 can be a winch that is located at a surface location, such as a drilling ship, an offshore platform, or a marine vessel. In FIG. 8, the line 98 is illustrated in a slack orientation in the manner shown herein previously in connection with FIG. 4. As such, the orientation and lock mechanism 100 extends at a angular position close to horizontal.

Figure 9:
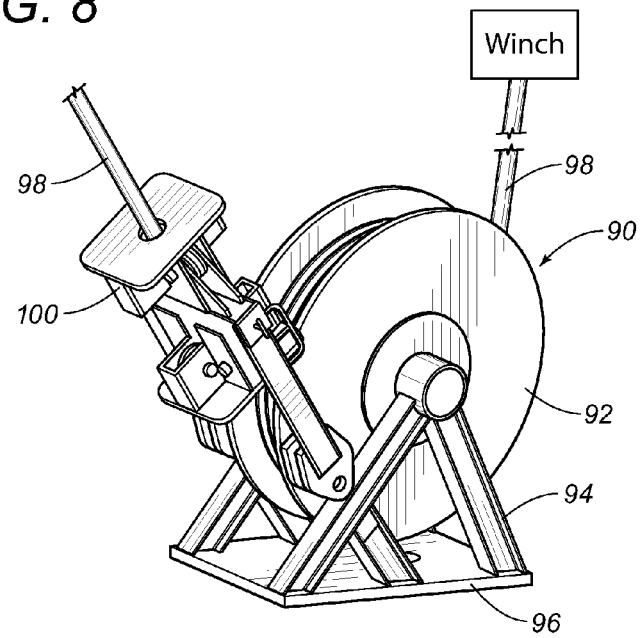
FIG. 9 is a perspective view showing the a wellhead integrity system of the present invention showing the line in a tensioned state.

FIG. 9 shows the tensioning mechanism 90 in which the line 98 has been properly tensioned. In particular, the winch 102 has been operated so as to draw the line 98 toward the reel 92 so as to properly tension the line 98. As the line 98 is tensioned, the orientation and lock mechanism 100 pivots upwardly from the frame 94. As such, it automatically adjusts relative to the tension applied to the line 94. The reel 92 will rotate as the winch 102 applies tension to the line 98. Once a proper tension has been achieved, suitable locking wedges, or other locking mechanisms, within the orientation and lock mechanism 100 can be actuated so as to secure the line 98 in its properly tensioned position. The wedging action associated with the orientation and lock mechanism 100 will prevent any release of tension from the line 94.

Figure 10:
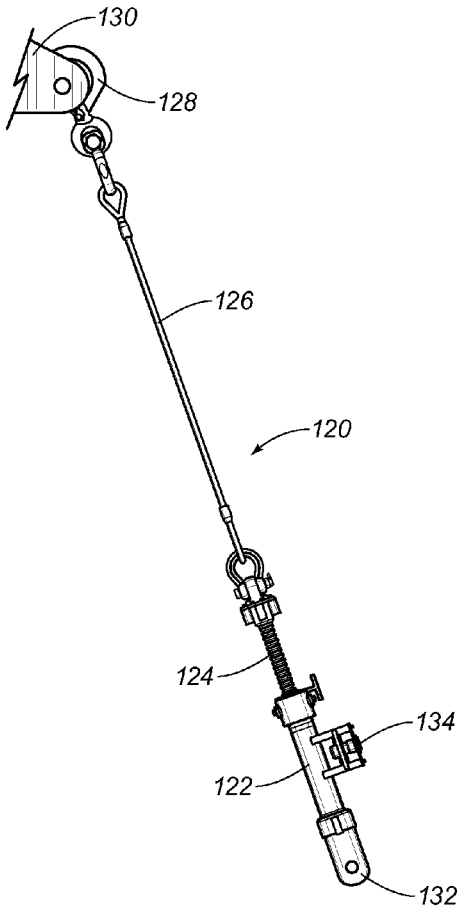
FIG. 10 is a side elevational view showing another embodiment of the tensioning mechanism of the wellhead integrity system of the present invention.

FIG. 10 illustrates an alternative embodiment of the tensioning mechanism of the present invention. In particular, the tensioning mechanism 120 includes a tensioning cylinder 122 having a ratchet rod 124 extending outwardly therefrom. In particular, a line 126 is secured to the ratchet rod 124. An opposite end of the line 126 can be secured to a shackle 128 that is mounted to a padeye 130 on the offshore structure 14. The lower end of the tensioning cylinder 122 includes a connector 132 that can be connected to the pile, or to another line. The tensioning cylinder 122, along with the ratchet rod 124, serves to draw the ratchet rod 124 inwardly of the tensioning cylinder 122 so as to exert a proper tension on the line 126. A suitable hydraulic connection 134 can be cooperative with the tensioning cylinder 122 so as to achieve the necessary "ratcheting" of the ratchet rod 124 inwardly. The ratchet rod 124 serves to avoid any release of the line 126 after the proper tension has been achieved. The padeye 130 can include a proper transducer or strain gauge so that a monitoring of the tension applied to the subsea structure can be achieved.

Figure 11:
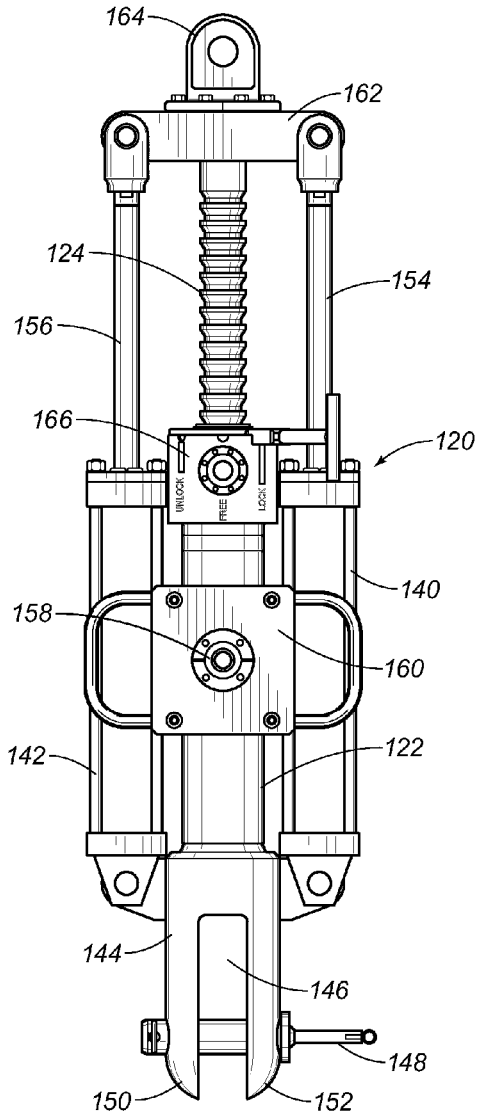
FIG. 11 is a detailed view showing the tensioning cylinder and ratchet rod as used in the alternative embodiment of the tensioning mechanism of FIG. 10.

FIG. 11 particularly illustrates the tensioning mechanism 120. In FIG. 11, can be seen that the tensioning mechanism 120 includes the tensioning cylinder 122. A first hydraulic actuator 140 is positioned on one side of the tensioning cylinder 122. A second hydraulic actuator 142 is positioned on the opposite side of the tensioning cylinder 122. The first hydraulic actuator 140 is in generally parallel relationship with the tensioning cylinder 122. The second hydraulic actuator 142 is also in parallel relationship to the tensioning cylinder 122. A connector 144 is formed at the bottom of the tensioning cylinder 122. Connector 144 is in the nature of a clevis having an internal slot 146. A pin 148 will extend between the flanges 150 and 152 of the connector 144 so as to properly engage with a suitable padeye, or other structure, formed on the top of the pile.

The first hydraulic actuator 140 will act upon a first piston rod 154. The second hydraulic actuator 142 acts on a second piston rod 156. The hydraulic pressure necessary to operate the piston rods 154 and 156 by the respective actuators 140 and 142 is achieved through the use of a hot stab 158 positioned on a faceplate 160. A yoke 162 is secured to the end of the piston rods 154 and 156 opposite the hydraulic actuators 140 and 142. The yoke 162 includes a suitable shackle 164 that can be connected to the end of the line 126.

In FIG. 11, it can be seen that the ratchet rod 124 extends from the yoke 162 to the interior of the tensioning cylinder 122. The ratchet rod 124 includes teeth formed on the exterior thereof. The teeth are suitable for engaging with a ratchet lock mechanism located within the tensioning cylinder 122. A controller 166 is mounted onto the tensioning cylinder 122. The controller 166 includes three settings "UNLOCK", "FREE" and "LOCKED". The "UNLOCK" position allows the teeth of the ratchet rod 124 to ratchet with respect to the ratchet lock mechanism. The "FREE" position allows for the free movement of the ratchet rod 124 with respect to the ratchet lock mechanism. The "LOCKED" position fixes a position of the ratchet rod 124 with respect to the tensioning cylinder 123. An ROV can be utilized so as to manipulate the controller 166 between these three positions. As such, control of the movement of the ratchet rod 124 is effectively achieved.

Figure 12:
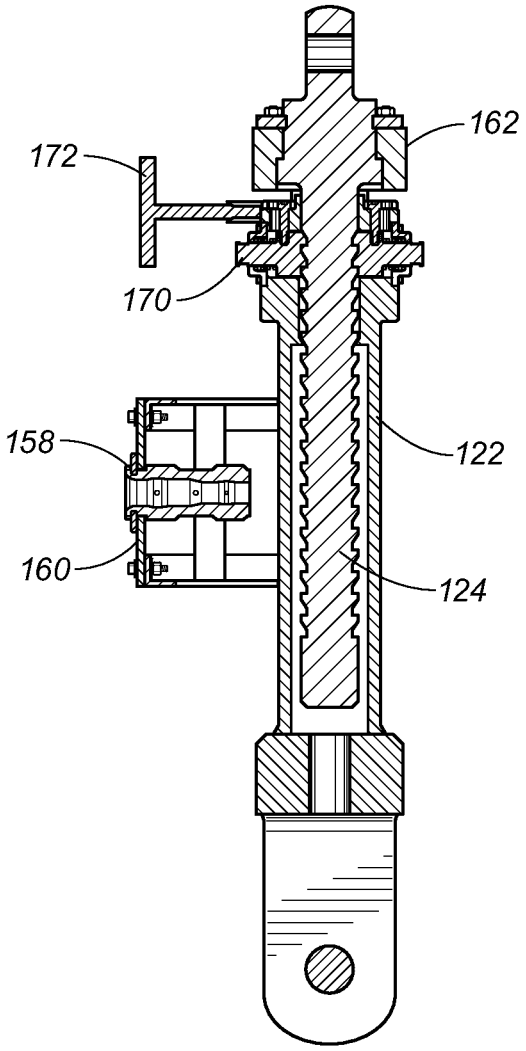
FIG. 12 is a cross-sectional view showing the tensioning cylinder and ratchet rod of the tensioning mechanism of the wellhead integrity system as shown in FIG. 10.

FIG. 12 illustrates the interior of the tensioning cylinder 122. FIG. 12 illustrates the ratchet rod 124 in its fully retracted position. As such, the yoke 162 will be located in close proximity to the end of the tensioning cylinder 122. The ratchet lock mechanism 170 has teeth which engage with the teeth of the ratchet rod 124. A control switch 172 is cooperative with the ratchet lock mechanism 170 so as to control the movement of the ratchet lock mechanism 170. The hot stab 158 is illustrated as mounted on the faceplate 160. The hot stab 158 allows hydraulic pressure to be introduced from an ROV into the hydraulic actuators 140 and 142. As such, the introduction of such hydraulic pressure will cause the ratchet rod 124 to move inwardly of the tensioning cylinder 122 so as to exert the necessary forces so as to tension the line 126 to its desired tension.

The present invention assures that the subsea structure maintains its proper orientation with respect to the wellhead. Additionally, the system of the present invention further serves to avoid undesired moments between the subsea structure and the flange at the upper end of the wellhead. As such, by compensating for forces applied by the subsea structure to the wellhead, the present invention preserves the integrity of the wellhead. As such, damage to the wellhead is effectively prevented through the use of the system of the present invention. Since damages are prevented, repair activities will not be necessary and the integrity of the wellhead is enhanced.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A method of protecting an integrity of a wellhead, the method comprising:
   - affixing a subsea structure to the wellhead;
   - installing at least a pair of piles into a subsea floor adjacent the wellhead;
   - extending lines between said subsea structure and the piles; and
   - tensioning said line such that each of the lines applies a tension to the subsea structure, the line having a tensioning cylinder affixed thereto, said tensioning cylinder having a ratchet rod extending therefrom, said ratchet rod affixed to either the line or the subsea structure or the pile, the step of tensioning comprising:
     - drawing said ratchet rod inwardly of said cylinder when a desired amount of tension is achieved; and
     - fixing a position of said ratchet rod within said cylinder when the desired amount of tension is achieved.

2. The method of claim 1, said subsea structure being a blowout preventer, the method further comprising:
   - affixing an end of each of the lines adjacent an upper portion of the blowout preventer.

3. A system for protecting an integrity of a wellhead, the system comprising:
   - a subsea structure suitable for attachment to the wellhead;
   - a plurality of lines affixed to said subsea structure and extending outwardly therefrom;
   - a plurality of piles arranged at a distance from the subsea structure, said plurality of piles suitable for installing into a subsea floor; and a tensioning mechanism cooperative with each of said plurality of lines so as to apply a tension thereto, said tensioning mechanism comprising:

a tensioning cylinder having a ratchet rod extending therefrom, said ratchet rod connected to either the line or the pile or the subsea structure, said tensioning cylinder suitable for drawing said ratchet rod inwardly so as to apply the desired amount of tension to the line.

* * * * *